United States Patent [19]

Langford

[11] 4,190,748

[45] Feb. 26, 1980

[54] KEYBOARD SWITCH ASSEMBLY

[75] Inventor: Gordon B. Langford, Chandler, Ariz.

[73] Assignee: Rogers Corporation, Rogers, Conn.

[21] Appl. No.: 763,925

[22] Filed: Jan. 31, 1977

[51] Int. Cl.[2] ..... H01H 13/70

[52] U.S. Cl. ..... 200/5 A; 200/86 R; 200/159 B; 200/275; 200/292

[58] Field of Search ..... 200/1 R, 5 R, 5 A, 67 R, 200/67 DA, 67 DB, 159 R, 159 A, 159 B, 292, 302, 306, 340, 275

[56] References Cited

U.S. PATENT DOCUMENTS

| | | | |
|---|---|---|---|
| 3,383,487 | 5/1968 | Wiener | 200/292 X |
| 3,718,791 | 2/1973 | Szablowski | 200/86 R |
| 3,800,104 | 3/1974 | Lien et al. | 200/67 DA X |
| 3,860,771 | 1/1975 | Lynn et al. | 200/329 X |
| 3,898,421 | 8/1975 | Suzumura | 200/306 X |
| 3,916,135 | 10/1975 | Holden et al. | 200/67 R X |
| 3,932,722 | 1/1976 | Obata et al. | 200/302 X |
| 3,941,953 | 3/1976 | Misson et al. | 200/302 X |
| 3,978,297 | 8/1976 | Lynn et al. | 200/302 X |
| 4,029,916 | 6/1977 | Chu | 200/340 X |
| 4,032,729 | 6/1977 | Koistiner | 200/1 R X |

FOREIGN PATENT DOCUMENTS 2459464 6/1975 Fed. Rep. of Germany ..... 200/159 B

OTHER PUBLICATIONS

R. K. Hayes et al., IBM Tech. Disc. Bull., "Snap-Action Membrane Switch Keyboard," vol. 7, No. 12, May. 1965, p. 1168.

*Primary Examiner*—James R. Scott

[57] ABSTRACT

A keyboard assembly and a keyboard switch are presented in which the keyboard switch is a layer of flexible insulating material with circuit configurations thereon and an array of flat topped protrusions which serve as key switches to effect a snap action contact with tactile feedback between a conductive element on the key switch and another conductive element. Preferably, the areas between the protrusions on the insulating layer are securely clamped relative to a backing or stiffening board, and the protruding key switches are operated by hinged key actuators which make off center contact with the protrusion.

22 Claims, 5 Drawing Figures

KEYBOARD SWITCH ASSEMBLY

BACKGROUND OF THE INVENTION

This invention relates to the field of keyboard assemblies and keyboard switch mechanisms. More particularly, this invention relates to a new and improved keyboard assembly and keyboard switch mechanism in which the key switches are an array of flat topped protusions in an insulating sheet having contoured conductive patterns, the protrusions operating in a snap action manner to provide pronounced tactile feedback to the keyboard operator.

In the past several years there has been a considerable increase in the market for keyboard type devices. The hand-held calculator has probably been the largest selling product of this type, but there are many other product areas where the use of electrical keyboard devices is expanding, such as computer and data terminals, and telephones, to mention only a few. Particularly in the hand-held computer market, price competition has emphasized the need to reduce the cost of these devices while retaining performance characteristics and reliability. One of the most important performance and reliability characteristics of these devices is known as tactile feel or tactile feedback, i.e. the physical sensation fed back to the finger of the operator indicating that the electrical circuit has been successfully completed upon depression of the key switch.

There have been recent proposals to form keyboard switching arrays by forming domes in an insulating sheet having conductive paths formed thereon. Switching arrays of this type have the potential to be much more economical than individual keys typically used in keyboard devices. However, these domed arrays have heretofore had particularly acute problems in providing the desired snap action or tactile feedback. One particular keyboard switch assembly with dome shaped actuators is shown in U.S. Pat. No. 3,860,771. That patent shows a configuration in which the keyboard switches are domed elements; i.e., domed elements having a distinct convex curvature when viewed from the top side, i.e. the side on which actuating force is applied. The description in U.S. Pat. No. 3,860,771 purports to disclose structure which provides snap action and tactile feedback. However, attempts to make a device in accordance with the disclosure of U.S. Pat. No. 3,860,771 with the switch array secured between the individual switching elements and using a hinged keyboard have failed to produce a device with snap action and tactile feedback. The ability to use a hinged key configuration is very important, because a keyboard having hinged keys is very economical to produce since it can be formed in a single molding operation and requires no separate assembly of the keys. Thus, the inability of the structure of U.S. Pat. No. 3,860,771 to operate in a hinged key environment is an extremely serious shortcoming and deficiency.

There have been several other disclosures in the prior art of domed keyboards, all of these being for configurations having concave domes such as in U.S. Pat. No. 3,860,771. In this regard, reference is made to IBM Technical Disclosure Bulletin, Hayes and Knapp, "Snap-Action Membrane Switch Keyboard", Vol. 7, No. 12, p. 1168, May 1965 and U.S. Pat. Nos. 3,898,421; 3,643,041; 3,590,195 and 486,212. Attention is also directed to U.S. Pat. Nos. 3,780,237; 3,699,294; 3,383,487 and 2,138,549. Although the foregoing enumerated references are not intended to be a list of all of the prior art known to applicant, they represent the most pertinent prior art presently known to applicant.

SUMMARY OF THE INVENTION

The above-discussed and other deficiencies of the prior art are overcome or significantly reduced by the present invention. In accordance with the present invention, a keyboard switch array is formed in a sheet of insulating material having conductive circuitry formed thereon. The conductive circuitry will be referred to as "printed circuitry", but it will be understood that the circuitry may be formed by either printed circuit techniques or any other technique known in the art, such as, for example, conductive inks or die stamping. The switch elements in this insulating or switch sheet are in the form of an array of protrusions, each of which has a flat top. The conductive patterns conform to the shape of the flat topped protrusions and are located on the bottom side of the protrusions, i.e. the side opposite to the side to which the actuating force is applied. In the preferred keyboard configuration, this switch sheet is firmly secured relative to a stiffener or backing board, and the switches are actuated by an array of hinged keys integrally formed in an upper layer of the keyboard assembly. The actuating force of the hinged keys is delivered to the individual switch protrusions at a position off center of the protrusions, and the resultant effect is a very distinct and pronounced snap action and tactile feedback to the key operator.

The switches of the switch sheet cooperate with another layer of conductive patterns on a second insulating layer or sheet to complete electrical circuits when the individual switches are actuated. The second sheet with its layer of conductive patterns will normally be flat and will have the conductive patterns facing and aligned with the conductive patterns on the switch sheet. The two sheets are separated by an insulating layer having an array of apertures through which the individual switches move with their snap action effect to make contact between the conductive patterns on the two layers. The second insulating layer may be a rigid insulating board with printed circuitry thereon, or it may also be a flexible insulating sheet with printed circuitry which would be backed by a stiffening board. If this second layer is a flexible sheet, it may be formed as a single sheet with the contoured switch sheet, in which event the single sheet would then be folded to form upper and lower layers sandwiched about the apertured insulating separator.

Accordingly, one object of the present invention is to provide a novel and improved keyboard assembly having snap action and tactile feedback.

Another object of the present invention is to provide a novel and improved keyboard switch mechanism having snap action and tactile feedback.

Still another object of the present invention is to provide a novel and improved keyboard assembly and keyboard switch mechanism which is economical to produce and is reliable in operation in producing snap action and tactile feedback.

Still another object of the present invention is to provide a novel and improved keyboard assembly and keyboard switch mechanism particularly suitable for hinged key operation.

Other objects and advantages of the present invention will be apparent to and understood by those skilled in the art from the following detailed description and drawings.

BRIEF DESCRIPTION OF THE DRAWINGS

Referring now to the drawings, wherein like elements are numbered alike in the several figures.

DESCRIPTION OF THE PREFERRED EMBODIMENT

Figure 1:
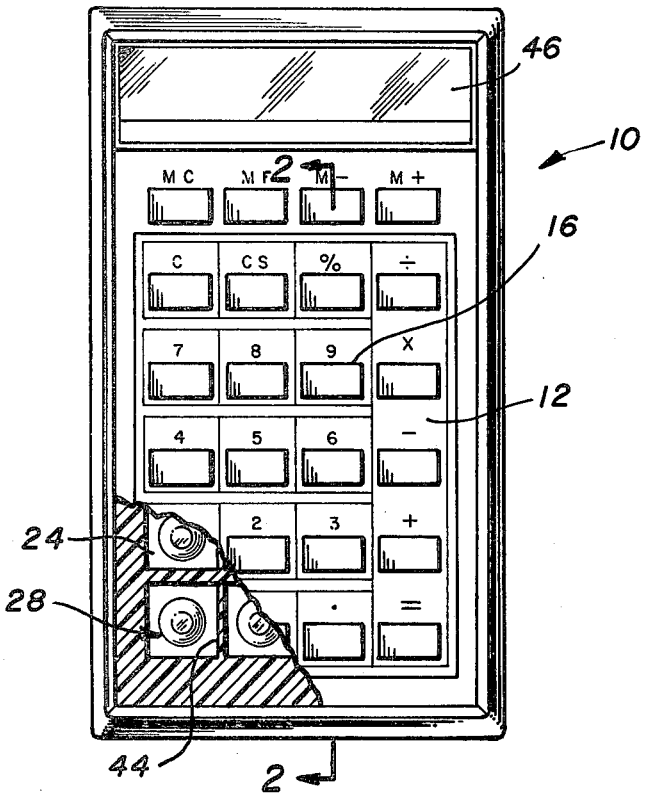
FIG. 1 is a top view of a keyboard incorporating the present invention, with part broken away.

Referring first to FIG. 1, a general configuration of a calculator with a keyboard 10 is shown. The outer case of the keyboard is typically formed of a high impact plastic, as is well known in the art. The upper surface of the keyboard may include a mask 12 on the upper surface, mask 12 having an array of openings 14 through which the tops of keys 16 project. The upper layer of the keyboard assembly (other than mask 12) is an integral layer 18 in which the keys 16 are formed. Each key 16 is hinged to layer 18 by a hinge section 20 which is an integral part of layer 18 of reduced gauge. Other than the hinge connection between each key 16 and sheet 18, the key is slightly spaced from the adjacent portions of layer 18, so that each key 16 occupies, in effect, an opening in upper layer 18 while being hinged at one side to upper layer 18. This living hinge formation of keys 16 is well known in the art. Force applied to the top of a key 16 will cause the key to pivot about hinge 20 and move the key downwardly to actuate a switch in the keyboard assembly. A force transmitting button 22 is pinned in the lower surface of each key 16 to localize the force transmitted through the key 16 to the switch.

Figure 2:
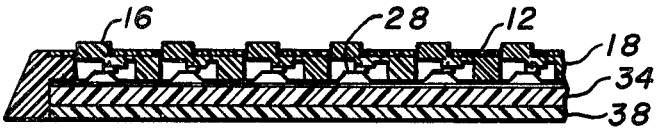
FIG. 2 is a partial sectional view taken along line 2—2 of FIG. 1.
Figure 3:
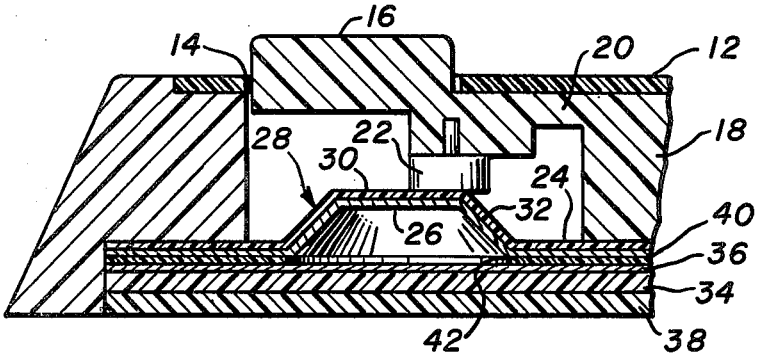
FIG. 3 is an enlarged view of a single flat topped protrusion switch of the present invention, with some parts exaggerated in size for purposes of illustration.
Figure 5:
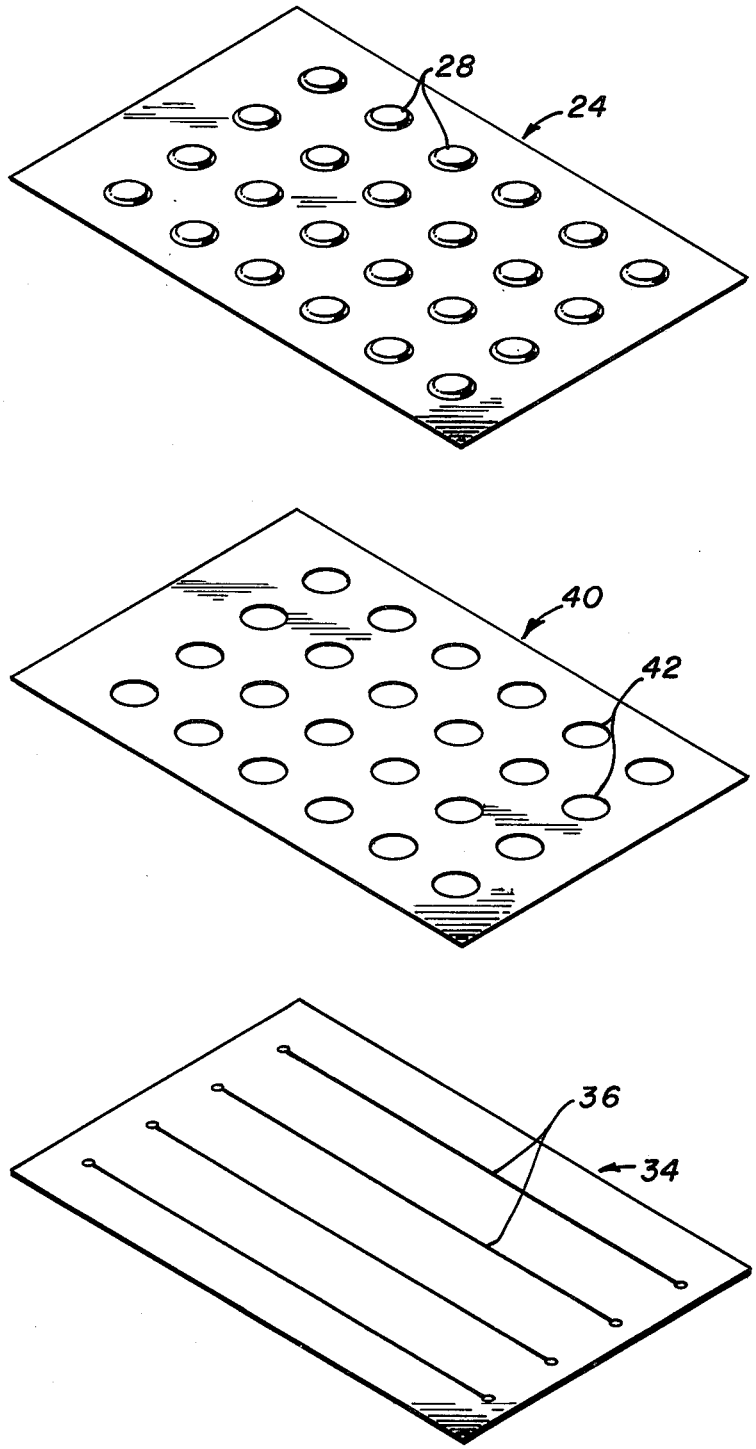
FIG. 5 is a partial exploded view of components of the keyboard switch configuration.

Referring particularly to FIGS. 2 and 3, the configuration of the key switch mechanism of the present invention is shown. The switch mechanism includes a first layer or switch sheet 24 of flexible plastic insulating material, such as Mylar or other suitable flexible insulating material. Conductive printed circuit patterns 26 are bonded to the lower surface of insulating sheet 24. An array of projections 28 extend above the upper surface of sheet 24, the array of projections corresponding to the array of hinged keys in the keyboard assembly. Each of the projections 28 has a pronounced flat top surface 30 which is connected by an outwardly sloping conical sidewall 32 to the main portion of sheet 24. As can best be seen from FIG. 1, each protrusion 28 is actually annular in shape in the form of a truncated cone. Sidewall 32 could be slightly curved if desired, but it is essential that the top surface of each projection be a distinct and pronounced flat surface essentially parallel to the main body of sheet 24. Although the particular shape of the printed circuitry on the lower surface of insulating sheet 24 will depend on the particular design and purpose of the keyboard assembly, a printed circuit conductor will be bonded to and conform in shape to at least part of the lower surface of flat portion 30 of each protrusion 28.

The keyboard assembly also includes a second or lower insulating sheet 34 having conductive printed circuit patterns 36 thereon. The second sheet of insulating material may also be a thin flexible material as is the upper sheet, in which case the assembly will also include a rigid stiffener or backing board 38 which may also serve as the back surface of the assembly casing. If insulating sheets 24 and 34 are both flexible sheets of insulating material with printed circuitry thereon, they may be formed from a single sheet with printed circuitry on one side thereof, the single sheet then being folded about some mid-line to form the two opposed sheets. Alternatively, the second insulating layer or sheet 34 may be a separate layer of rigid insulating material with printed circuitry formed thereon. A separator sheet 40 is located between the upper switch sheet 24 and the lower sheet 34 to insulate the conductive circuitry on switch sheet 24 from the conductive circuitry on lower sheet 34. Separator sheet 40 has an array of openings 42 therein aligned with each of the projections of switches 28 to permit contact to be made between a conductor pattern 26 on switch sheet 24 and a conductor pattern 36 on lower sheet 34 when a key 16 is depressed to snap the switch 28 and move it through the opening 42. Rigid divider bars 44 on the undersurface of keyboard assembly layer 18 contact switch sheet 24 between the individual projections of switches 28 to secure switch sheet 24 between the divider bars and backing board 38. This gripping action of sheet 24 between divider bars 44 and backing board 38 serves to confine switch sheet 24 relative to backing board and firmly fix the position of the switch sheet against relative movement in the assembly. In addition, either or both of insulating sheets 24 and 34 may be adhesively bonded to the opposite sides of separator sheet 40.

Figure 4:
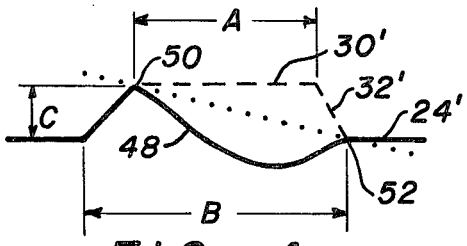
FIG. 4 is a representation of the snap action effect of the flat topped switch of the present invention.

In operation of the keyboard switch mechanism of the present invention, actuating force will be delivered, typically from the finger of a user, to depress key 16 to cause the key to pivot about hinge 20. This pivoting of key 16 delivers the actuating force through button 22 off center to switch 28 causing the switch to move with snap action through opening 42 to establish contact between the conductive pattern 26 on the bottom side of the switch and the conductive pattern 36 on the upper surface of insulating layer 34. The snap action, results in a tactile feedback to the user. In a manner well known in the art, and depending on the particular nature and function of the keyboard involved, this contact between the conductive elements will complete a circuit, either by bridging contacts on lower sheet 34 or by completing a circuit between conductors on upper sheet 24 and lower sheet 34 to cause a logic or other function to be performed. In a typical hand-held calculator, data will eventually appear in a display window 46. When the actuating pressure is removed from key 16, the flexible protrusion will automatically return to the normal position shown in FIG. 3. FIG. 4 depicts the way in which the snap action occurs in the switch of the present invention. The various parts of a switch and the switch sheet are represented by the corresponding numbers in FIG. 3, with the addition of a prime (′) designation. The regular or unactuated condition of the switch is represented by the dashed line in FIG. 4, while the actuated position with snap action is shown by the solid line which has been numbered 48. As can be seen, the switch of the present invention has a snap action where the upper flat portion snaps through an imaginary line which extends between points 50 and 52, the line being designated with number 54 and being shown as a dotted line. Thus, the switch of the present invention snaps through a line which is at an angle to the plane of the body of sheet 24, whereas prior art curved domed configurations have purported to have a snap action in which the snap is through a line which is in the plane of the switch sheet. The switch configuration of the present invention provides a very distinct and significantly improved snap action and tactile feedback as compared to that which can be achieved in the prior art, especially when a hinged key is used and the switch plate is confined relative to a backing or stiffening board.

As will be recognized from the foregoing description, the protrusion which forms the switch of the present invention is in the shape of a truncated cone. Research has determined that there is a range of preferred dimensions for this truncated cone. Referring to FIG. 4, the dimensions indicated as A, which is the diameter of the flat top of the truncated cone, should range from 0.070 inches to 0.150 inches; the dimension indicated at B, which is the diameter of the base of the truncated cone, should range from 0.160 to 0.380 inches; and the dimension indicated at C, which is the height of the truncated cone, should range from 0.011 inches to 0.027 inches. Also, it has been determined that for any given height C, the preferred ratio A:B, i.e. the ratio of the diameter of the flat surface to the diameter of the base, should be in the range of from 1:2.5 to 1:3. It has also been determined that the button 22 should contact the flat surface at a location which is from approximately 0.030 to 0.045 inches off the center line of the truncated cone, and it will be noted that the point of application of the actuating force at this off center location may either be on the flat surface 30 or on the sloping side 32. However, in order for the switch of the present invention to function properly, the actuating force must be applied to the switch at an off center location.

In forming the protrusions to be used in the present invention, the switch sheet 24 is first formed in a flat sheet with the printed circuit patterns thereon. The flexible sheet of insulating material with printed circuitry thereon is then placed in a suitable die to be drawn and deformed under heat and pressure to form the array of protruding switches.

While preferred embodiments have been shown and described, various modifications and substitutions may be made thereto without departing from the spirt and scope of the present invention. Accordingly, it will be understood that the present invention has been described by way of illustration and not limitation.

What is claimed is:

1. A keyboard assembly including:

hinged key means for delivering an input signal, said key means normally being in one position and being movable to a second position;

first insulating means spaced from said key means, said insulating means having first conductive means on a side thereof spaced from said key means;

flexible switch means projecting from said first insulating means toward said key means, said switch means having an inclined annular side surface extending to a flat top surface, at least part of said first conductive means being on the underside of said flat top surface;

second insulating means on the side of said first insulating means opposite to said key means, said second insulating means having second conductive means facing but out of contact with said first conductive means; and securing means to fix the position of said first insulating means against lateral movement relative to said key means;

said key means contacting said flat top surface of said switch means at an off center location and causing said switch means to move with snap action from its normal state to an operated position to establish contact between said first conductive means on the underside of said flat top surface and second conductive means upon movement of said key means toward its second position, said switch means returning to its normal state upon return of said key means to its first position;

each of said switch means moving through a plane inclined to the plane of said first insulating means, said inclined plane extending in direction from approximately an intersection of said side surface and said first insulating means to a diametrically opposed intersection of said side surface and switch means top surface.

2. A keyboard assembly as in claim 1 including:

separator means between said first and second insulating means, said separator means having aperture means aligned with said switch means to permit contact to be established between said first and second conductive means.

3. A keyboard assembly as in claim 1 wherein:

said switch means is in the form of a truncated cone having a base diameter of from 0.160 to 0.380 inches, said flat top has a diameter from 0.070 to 0.120 inches, and a height of 0.011 to 0.027 inches.

4. A keyboard assembly as in claim 3 wherein:

the diameter of said flat top surface to said base is in the ratio of from 1:2.5 to 1:3.

5. A keyboard assembly as in claim 3 wherein:

said key means contacts said switch means at a distance off center of approximately 0.030 to 0.045 inches.

6. A keyboard assembly as in claim 5 including:

separator means between said first and second insulating means, said separator means having an apertured array aligned with said switch means to permit contact to be established between said first and second conductive means.

7. A keyboard assembly as in claim 1 wherein said first conductive means includes:

at least one circuit pattern extending along part of said sheet means and following the contour of at least part of the underside of said switch means.

8. A keyboard assembly including:

a plurality of hinged key means in an array for delivering input signals, each of said key means normally being in one position and being movable to a second position;

first insulating sheet means spaced from said key means, said insulating means having first conductive means on a side thereof spaced from said key means;

a plurality of flexible switch means projecting from said first insulating means toward said key means, said switch means being in an array corresponding to the array of key means, and each of said switch means having an annular side surface extending to a flat top surface, at least part of said first conductive means being on the underside of said flat top surface;

second insulating means on the side of said first insulating means opposite to said key means, said second insulating means having second conductive means facing but out of contact with said first conductive means; and securing means to fix the position of said first insulating means against lateral movement relative to said key means;

each of said key means contacting said flat top surface of a corresponding switch means at an off center location and causing said corresponding switch means to move with snap action from its normal state to an operated position to establish contact between said first conductive means on the underside of said flat top surface and second conductive means upon movement of said key means toward its second position, said switch means returning to its normal state upon return of said key means to its first position;

each of said switch means moving through a plane inclined to the plane of said first insulating means, said inclined plane extending in direction from approximately an intersection of said side surface and said first insulating means to a diametrically opposed intersection of said side surface and switch means top surface.

9. A keyboard assembly as in claim 8 wherein:

each of said switch means is in the form of a truncated cone having a base diameter of from 0.160 to 0.380 inches, said flat top has a diameter from 0.070 to 0.150 inches, and a height of 0.011 to 0.027 inches.

10. A keyboard assembly as in claim 9 wherein:

the diameter of said flat top surface to said base is in the ratio of from 1:25 to 1:3.

11. A keyboard assembly as in claim 9 wherein:

said key means contacts said switch means at a distance off center of approximately 0.030 to 0.045 inches.

12. A keyboard assembly as in claim 8 wherein said first conductive means includes:

at least one circuit pattern extending along part of said sheet means and following the contour of at least part of the underside of said switch means.

13. Flexible switch means including:

a sheet of flexible insulating material;

conductive patterning means on at least one side of said sheet of insulating material; and an array of protrusions formed in and extending from the other side of said sheet of insulating material;

each of said protrusions having an inclined annular side surface extending to a flat top surface, each of said protrusion flat top surfaces normally being parallel to the plane of said sheet and having an area less than the base area of the protrusion as defined by the junction of said side surfaces and said sheet;

at least part of said conductive patterning means being on the underside of the flat top surface of each of said protrusions;

each of said protrusions being movable with snap action from the normal position thereof to a depressed operated position through a plane inclined at an angle to the plane of said sheet, said inclined plane extending in a direction from approximately an intersection of said side surface and said sheet to a diametrically opposed intersection of said side surface and protrusion top surface.

14. Flexible switch means as in claim 13 wherein:

each of said protrusions is in the form of a truncated cone having a base diameter of from 0.160 to 0.380 inches, said flat top has a diameter from 0.070 to 0.150 inches, and a height of 0.011 to 0.027 inches.

15. Flexible switch means as in claim 14 wherein:

the diameter of said flat top surface to said base is in the ratio of from 1:25 to 1:3.

16. A flexible switch as in claim 13 wherein said conductive patterning includes:

at least one circuit pattern extending along part of said insulating material and following the contour of at least part of the underside of said protrusion.

17. For use with a switch assembly including a substrate having a first switch contact arrangement disposed thereon, a second switch contact arrangement normally disposed in spaced-apart relation relative to the first switch contact arrangement and an actuator key disposed adjacent the second switch contact arrangement a relatively thin, planar layer of flexible material having a protrusion therein and adapted to be mounted adjacent the substrate with the protrusion disposed between the actuator key and the second switch contact arrangement, the protrusion being comprised of a flat top portion parallel to and spaced-apart from the planar layer and a surrounding conically shaped sloping side portion extending downwardly and outwardly from the top portion to the planar layer.

18. The invention set forth in claim 17, wherein the planar layer is made of polyester film.

19. A switch assembly comprising the combination of a bottom member having a plurality of key contact regions on one side thereof, at least one conductive member disposed on the bottom member at each of the key contact regions, a relatively thin piece of resilient, flexible material disposed adjacent the bottom member and having a plurality of protrusions therein, each of the protrusions being disposed over a different one of the key contact regions and having a flat top portion and a surrounding side portion sloping outwardly and downwardly along a line at fixed angle relative to the top portion, at least one conductive contact closure member disposed between each protrusion and the conductive member disposed on the bottom member at the adjacent key contact region and an actuator assembly disposed on the opposite side of the relatively thin piece of resilient, flexible material from the bottom member and having a plurality of depressible actuator keys therein, each key being disposed above a different one of the protrusions in the relatively thin piece of resilient, flexible material.

20. A switch assembly comprising:

a planar substrate having a conductive circuit pattern printed on a surface thereof, the circuit pattern defining a plurality of sets of switch contacts;

a planar spacer disposed adjacent the surface of the substrate and having a different aperture therethrough at each of the sets of switch contacts; and a thin layer of flexible material having a planar portion disposed adjacent the spacer opposite the substrate and having a different protrusion therein adjacent each of the different apertures in the spacer, each of the protrusions being a continuation of the layer and extending outwardly from the layer on the opposite side of the layer from the spacer and having a shape generally conforming to a conical section, the shape being defined by a flat, generally circular top and a sloping nonspherical sidewall configuration extending linearly between the top and the planar portion of the layer.

21. A switch assembly comprising:

a planar substrate having a conductive circuit pattern printed on a surface thereof, the circuit pattern defining a switch contact array;

a spacer including a first planar layer of flexible material disposed adjacent the surface of the substrate and having a different aperture therethrough at each discrete location of the switch contact array defining a switch station;

a second planar layer of flexible material disposed adjacent the spacer on a side opposite the substrate and having a different protrusion therein adjacent each of the different apertures in the spacer, each of the protrusions extending outwardly from the second layer on the opposite side of the layer from the spacer and being in the shape of a conical section with a flat top extending parallel to the plane of the second layer and sloping conical walls extending between the flat top and the plane of the second layer, the second layer having a switch closure conductive circuit pattern printed on the inside of each protrusion; and a plurality of actuator keys disposed adjacent the planar layer on the side thereof opposite the spacer, each of the keys being positioned adjacent a different one of the protrusions in the layer and being operative to flex the protrusion downwardly so that the conductive circuit pattern printed on the inside of the protrusion extends through the adjacent aperture in the spacer and contacts the switch contact array on the substrate adjacent the aperture in the spacer.

22. The invention set forth in claim 21 wherein each protrusion has a relatively flat, circular top portion disposed in parallel, spaced-apart relation to the plane of the second planar layer, and a side portion surrounding the upper surface and extending downwardly and outwardly and intersecting the plane of the second planar layer in a circle which is larger than the upper surface.

* * * * *